US005419164A

United States Patent [19]

Durazzani

[11] Patent Number: 5,419,164

[45] Date of Patent: May 30, 1995

[54] PLASTIC TUBS FOR WASHING MACHINES

[76] Inventor: Pierro Durazzani, Via Lazio 7, 33080 Porcia, Pordenone, Italy

[21] Appl. No.: 159,824

[22] Filed: Nov. 30, 1993

[30] Foreign Application Priority Data

Dec. 7, 1992 [IT] Italy ..... PN92A0091

[51] Int. Cl.[6] ..... D06F 23/2; D06F 37/22

[52] U.S. Cl. ..... 68/23.2; 68/142

[58] Field of Search ..... 68/23.2, 142; 210/363, 210/364

[56] References Cited

FOREIGN PATENT DOCUMENTS

| | | | |
|---|---|---|---|
| 0551067 | 7/1993 | European Pat. Off. . | |
| 2633604 | 2/1978 | Germany | 68/23.2 |
| 2004305 | 3/1979 | United Kingdom | 68/23.2 |
| 2216906 | 10/1989 | United Kingdom | 68/23.2 |
| 2241251 | 8/1991 | United Kingdom . | |

*Primary Examiner*—Philip R. Coe

[57] ABSTRACT

A clothes washing machine or combined clothes washing and drying machine, of the household type, is provided with a plastic tub (1) accommodating a spin drum (2) in which the clothes to be washed are loaded. The tub has a cylindrical mantle or outer wall (3) which is integral with a rear wall (4). A front wall (5) is molded separately and attached to the tub. A plurality of counterweights (6,7) contained in plastic shells (8,9) are attached to the tub, wherein the shells (8,9) are provided with an appropriate plastic projection (10,11) which fits together or mates with a corresponding plastic projection (12,13) located on an outer structure of the tub. The plastic projections (10,12 and 11,13) are fastened together through fusion-welding in order to firmly attach the counterweights to the tub.

13 Claims, 3 Drawing Sheets

PLASTIC TUBS FOR WASHING MACHINES

BACKGROUND OF THE INVENTION

This invention relates in general to a clothes washing machine or a combined clothes washing and drying machine of the household type, and more particularly to a washing machine, or a combined washing and drying machine, having a molded plastic washing tub with improved means to retain and hold an associated ballast member or counterweight in place.

Molded plastic washing tubs for clothes washing machines are known in the art to comprise a generally rigid structure forming the cylindrical peripheral wrapping or outer wall, an associated circular rear or bottom wall, and a circularly shaped front or top wall. The front or top wall is sometimes separable and is capable of being joined to the remaining tub components with known fastening means.

Appropriate heavy elements, acting as counterweights or ballasts, are usually associated with, ie. fixed to, the tubs, in order to counterbalance the tub, ie. to increase its inertia, and as a consequence limit oscillations that are generated on the tub during spin-extraction phases. When the rotating or spin drum holding the washload is driven to rotate at its highest revolution speed, ie. a speed that is considerably higher than the one at which the same spin drum typically rotates during washing and rinsing phases, the counterweights or ballast limit undesirable oscillatory movement of the tub.

Such oscillations are induced by conditions arising from an uneven distribution of the washload along the cylindrical outer wall of the rotating drum. If no measure is taken to dampen such oscillations, a number of drawbacks and problems well known in the art arise.

Counterpoising or ballast means for clothes washing machine tubs of the subject type are known to be formed by one or more blocks of concrete or various similar masses of material with a high specific weight. The counterpoising blocks or masses are first separately formed in advance to an appropriate shape and are then attached in a suitable arrangement to the washing tub of the respective washing machine by means of any of a number of removable fastening means such as screws, bolts, nuts, and the like.

However, these types of counterweights have a drawback in that they require a relatively long time for the concrete to be prepared and duly hardened. The concrete blocks furthermore carry with them the risk of coming or breaking off seats provided for their attachment to the tub due to vibrations that are generated by the operation of the machine. The vibrations can sometimes actually cause the concrete blocks to collapse and disintegrate.

Additional types of counterweights for clothes washing machine tubs are known, for example Italian Utility Model No. 34081/B/89, discloses concrete blocks that are prepared in advance. A plastic material is then applied onto the block by an overinjection molding technique so as to form an appropriately shaped enclosed wrapping capable of both preventing the blocks from becoming unduly displaced and undesirably breaking off. The blocks are attached in a traditional manner to the tub of the washing machine.

Even with the plastic wrapped blocks, however, there is the drawback of the relatively long time required for the concrete blocks to be prepared and hardened. This is a clear disadvantage from an economic point of view. Furthermore, the blocks require a rather complicated manufacturing process due to the overinjection of the plastic wrapping.

Among the various solutions suggested or proposed in this connection, a particularly interesting one is disclosed in the Italian Patent Application No. PN92A000002 titled "Improvement in the ballast arrangement for clothes washing machines".

The Italian patent application discloses a container which is associated or fixed to a plastic washing tub and is capable of being filled with appropriate ballasting means, preferable water, when the machine is installed. The advantage of such a solution resides in the fact that clothes washing machines produced according to this concept are much lighter in weight and, therefore, more convenient to handle during transportation and installation. The clothes washing machines are also less expensive due to both the reduction in transportation costs and the savings achieved through avoidance of manufacturing costs of a traditional ballast made of a heavyweight material such as cast-iron or concrete.

Even this solution, however, has a drawback in that it fails to identify in a sufficiently clear and complete way the most adequate technique to be used to manufacture the washing tub of plastic material with the ballast containing arrangement associated therewith. This of course makes practical implementation of the solution rather problematic.

It is therefore a purpose of the present invention to overcome these drawbacks by providing a plastic tub for clothes washing machines and an associated counterweight, made of high specific-weight material and enclosed in a protective shell of plastic material that is capable of being attached to the plastic tub in such a way to make it possible to easily and quickly install the shell to the structure of the tub.

SUMMARY OF THE INVENTION

According to the invention there is provided a plastic washing tub which accommodates a rotating or spin drum into which clothes are loaded. The washing tub has a cylindrical outer wall integral with a rear or bottom wall. A front or top wall is provided and attached on the tub at a front or top opening of the tub. Counterweights or ballasts contained in plastic shells are attached to the tub. A plastic projecting element provided on at least one of the shells is adapted to fit together with a corresponding plastic projecting element provided on an outer structure of the tub. The projections are fastened together through a fusion-weld of the plastic in order to firmly attach the counterweights to the tub.

BRIEF DESCRIPTION OF THE DRAWINGS

The invention will be further described by way of non-limiting example with reference to the accompanying drawings in which.

DETAILED DESCRIPTION OF THE PREFERRED EMBODIMENT

Figure 1:
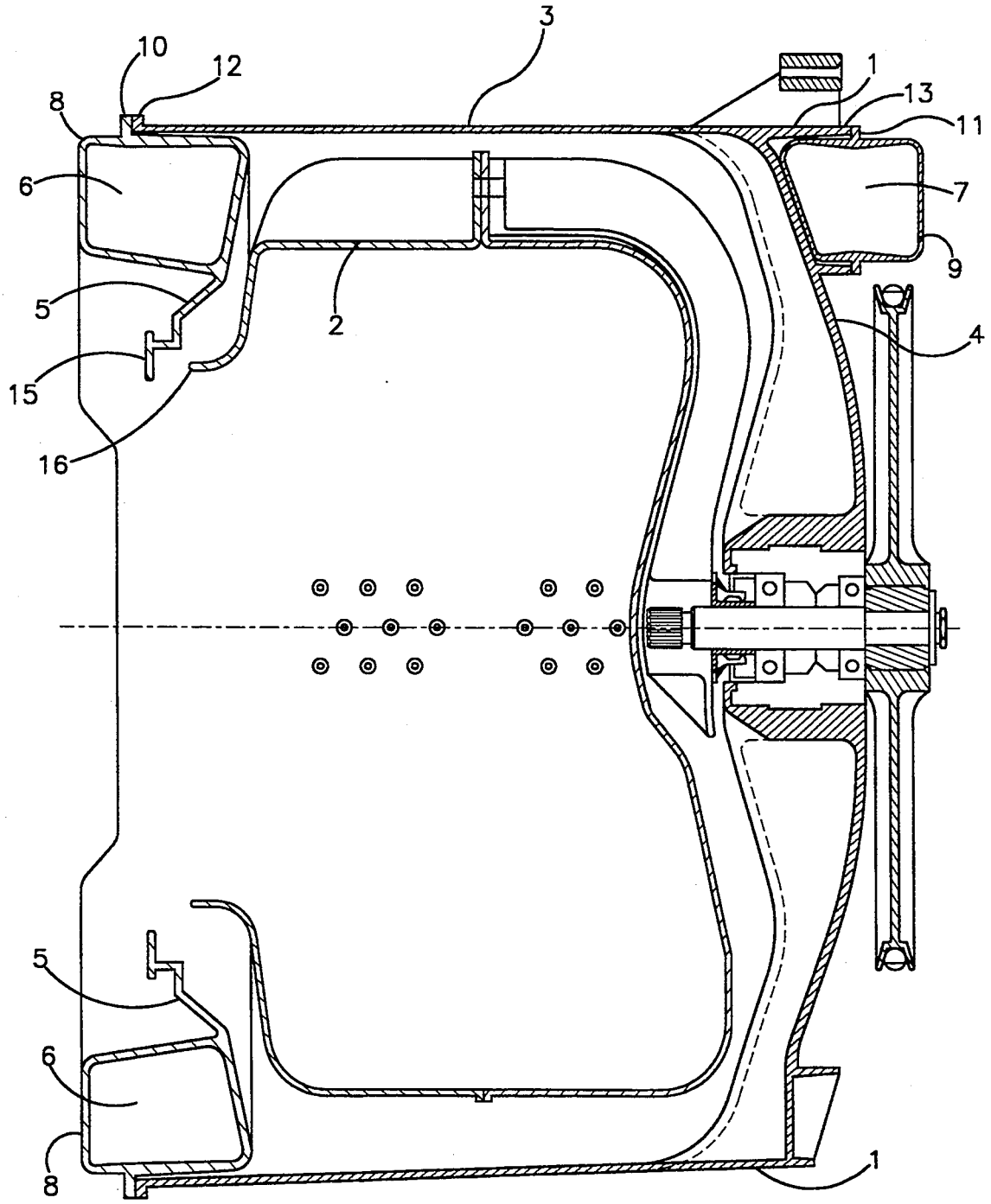
FIG. 1 is an elevational view, in cross-section, of a tub assembly for a clothes washing machine according to the present invention.
Figure 2:
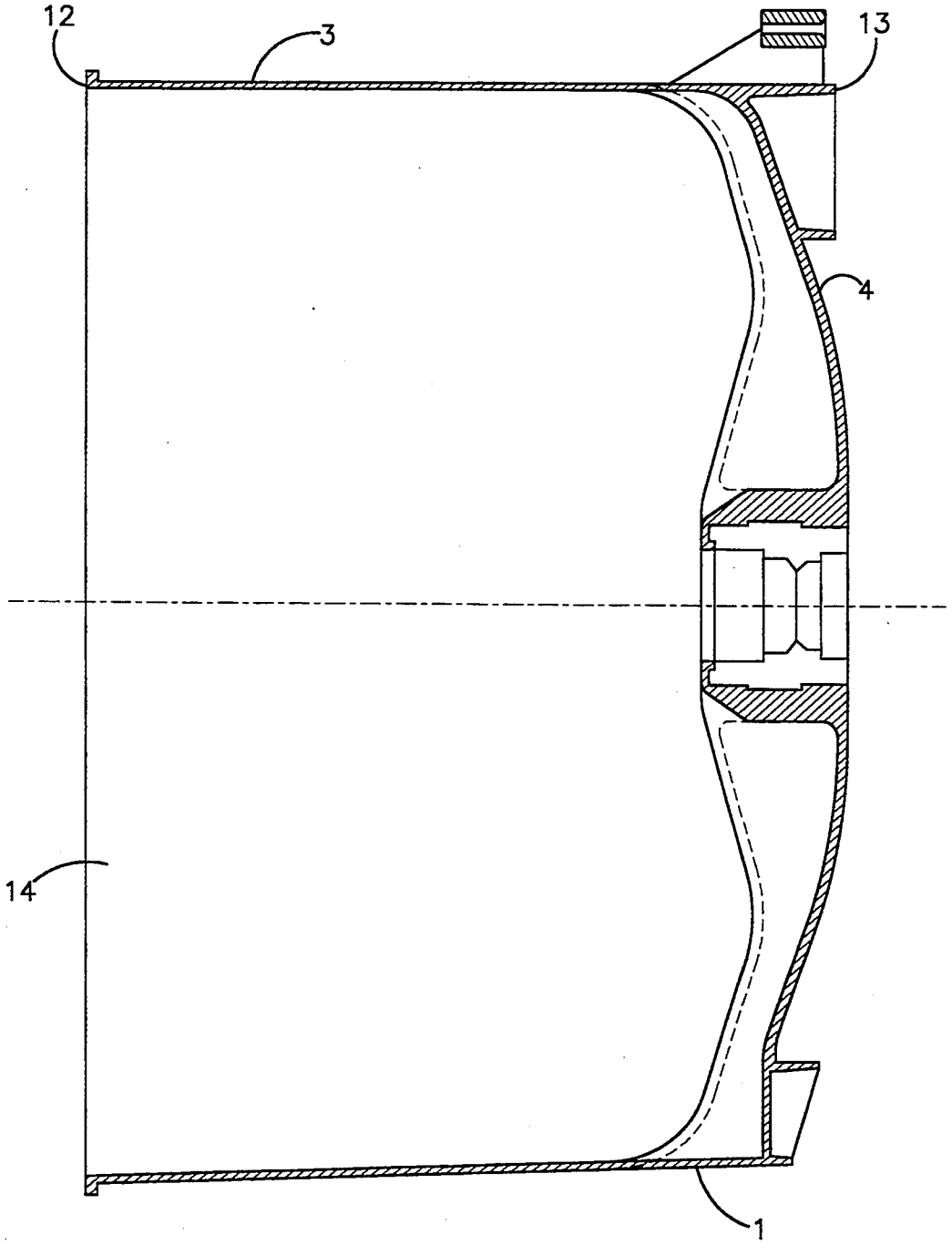
FIG. 2 is an elevational view, in cross-section, of the washing tub of FIG. 1.
Figure 3:
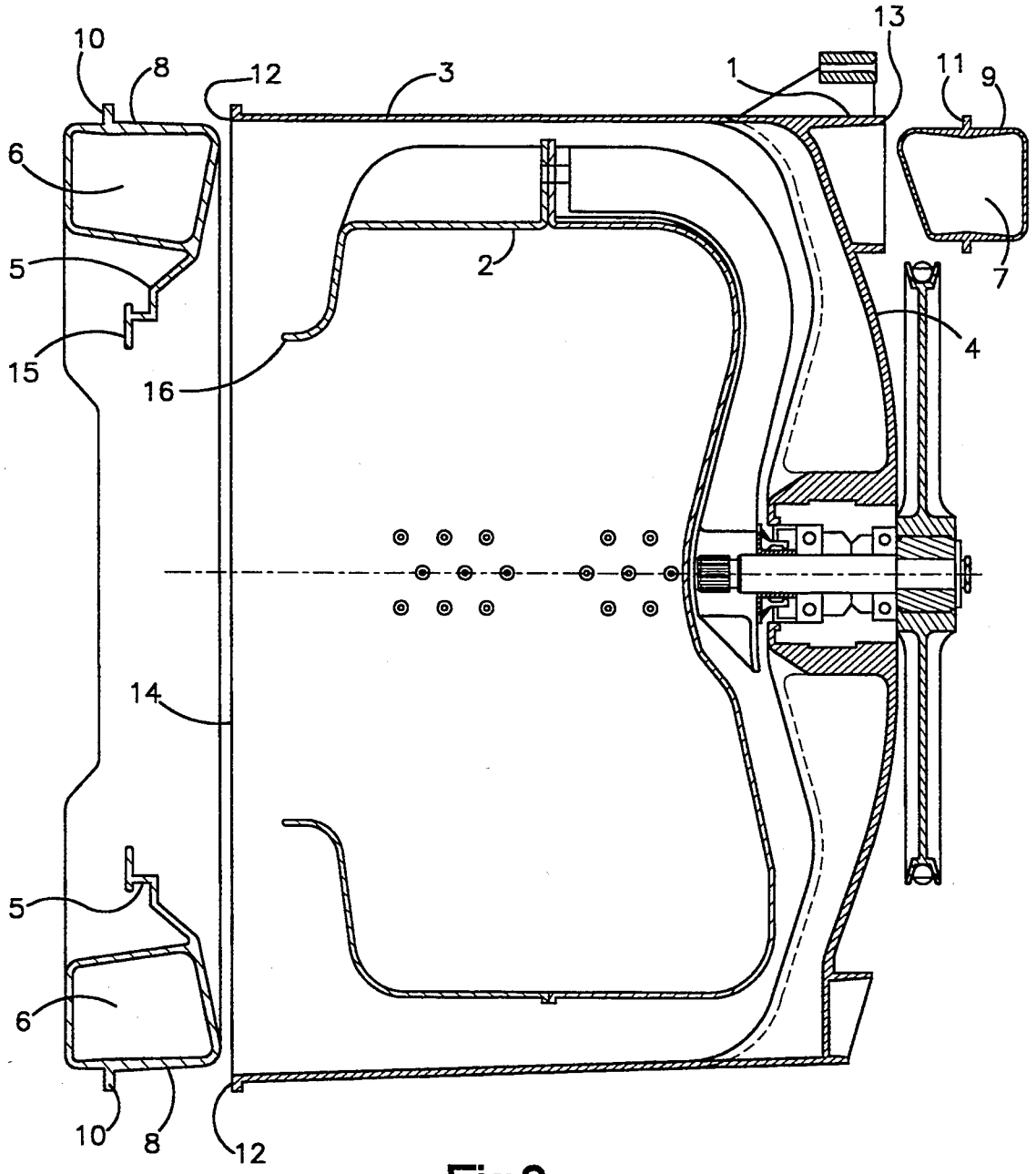
FIG. 3 is an elevational view, in cross-section, of the tub assembly of FIG. 1 with the counterweights or ballasts separated therefrom.

Referring now to the Figures, it can be seen that they illustrate a washing tub 1 made of plastic material which is adapted to be installed in a known manner in a clothes washing machine. The tub 1 accommodates a known type of perforated spin drum 2. The tub 1 comprises a generally rigid structure formed by a cylindrical peripheral wrapping or outer wall 3 integral with a rear or bottom wall 4. A front or top wall 5 is attached to the tub 1 at a front opening 14 of the tub 1.

The tub 1 is ballasted on both its front and rear sides by ballasts or counterweights 6, 7, respectively, which are correspondingly contained in enclosed plastic shells 8, 9.

The front-side shell 8 is provided with an appropriate plastic projection 10 that is adapted to couple or mate with a corresponding plastic projection 12 provided on an edge of the tub front opening 14. In a similar way, the rear-side shell 9 is provided with an appropriate projection 11 that is adapted to couple or mate with a corresponding plastic projection 13 provided on the tub rear wall 4.

The front and rear shells 8, 9 are positioned against the front opening 14 and the rear wall 4 of the tub, respectively, such that the respective projections fit together and couple with each other in the above described way. After positioning the shells 8, 9 on the tub 1, the shells 8, 9 are fastened in position by melting the matching projections 10,12, 11,13 together by a fusion-welding process.

This fusion-welding process can be carried out by means of any known fusion-welding technique used to join plastic parts, such as for instance ultrasonic welding or the so-called "mirror-type" welding technique. The joining at the projections 10, 12, and 11, 13 achieves a firm fastening of the ballasts or counterweights 6, 7 to the tub 1.

To obtain a complete tub assembly, it is also necessary that the tub front opening 14 be appropriately closed with an annular diaphragm. The annular diaphragm must be capable of snugly adapting itself to both a front or top edge 16 of the spin drum 2 and a bellows-like gasket (not shown). An outer edge of the gasket gets closed against the loading door of the machine to provide a seal.

To this aim, an effective improvement lies in integrally forming a plastic annular diaphragm 15 to the front or top wall 5 and the front-side shell 8. The diaphragm 5 must have a required wall thickness and overall shape, as best seen in FIG. 1.

It can now be appreciated that heavy-weight materials other than concrete can be used to make up the counterweights or ballasts 6, 7. The shells 8, 9 can also be formed to shapes other than those described above by way of non-limiting example, provided that the counterweights or ballasts 6, 7 are contained within cavities of the shells 8, 9, using traditional processing methods suiting the particular application.

In a most advantageous way, the counterweights or ballasts 6, 7 can be formed of calcium carbonate. As a matter of fact, calcium carbonate is a compound that can be added as a filler to plastic to reach desired properties of the final plastic material or part. As a consequence, when the washing machine is eventually to be scrapped and all its reusable materials have to be recovered for recycling, the shells 8, 9 can be readily detached without any difficulty and sent immediately to regrinding, since the masses of the inert material contained therein, ie. calcium carbonate, do not need to be first separated from the other plastic parts to be recycled.

It will be further appreciated that each tub 1 may be made to any shape, other than the above illustrated one, as may be considered to be appropriate without departing from the scope of the present invention.

Although particular embodiments of the invention have been described detail, it will be understood that the invention is not limited correspondingly in scope, but includes all changes and modifications coming within the spirit and terms of the claims appended hereto.

What is claimed is:

1. Clothes washing machine comprising a plastic washing tub (1) accommodating a rotating drum (2) into which a washload is loaded, said washing tub having a cylindrical outer wall (3) defining a front opening (14) a rear wall (4) integral with the outer wall, a front wall (5) attached to said tub at the front opening (14) of said tub, and counterweights (6,7) contained in plastic shells (8,9) attached to said tub, wherein the improvement comprises at least one of said shells (8,9) having a plastic projecting element (10,11) arranged to fit together with a corresponding plastic projecting element (12,13) of said tub, said projecting element (10,11) and said corresponding projecting element (12,13) being firmly fastened together by a fusion-weld of the plastic material.

2. Clothes washing machine according to claim 1, wherein said tub front opening (14) defines an edge and at least one of said plastic shells (8) is attached on said tub at said front opening (14) thereof, the projecting element (10) of said shell (8) at said front opening being arranged to fittingly match against the corresponding projecting element (12), and the corresponding projecting element being provided on the edge of said tub front opening.

3. Clothes washing machine according to claim 2, wherein said front shell (8), said projecting element (10) of said shell at said front opening, and the corresponding projecting element (12) provided on said tub front opening are substantially annularly-shaped.

4. Clothes washing machine according to claim 3, wherein said tub rear wall (4) defines an outer circular edge and at least one of said plastic shells (9) is attached on said tub at said rear wall (4) thereof, the projecting element (11) of said shell (9) at said rear wall being arranged to fittingly match against the corresponding projecting element (13) provided substantially on the outer circular edge of said tub rear wall (4).

5. Clothes washing machine according to claim 4, wherein said front wall (5) is formed integrally with said front annularly shaped shell (8).

6. Clothes washing machine according to claim 5, wherein said counterweights (6,7) comprise calcium carbonate.

7.Clothes washing machine according to claim 4, wherein said counterweights (6,7) comprise calcium carbonate.

8. Clothes washing machine according to claim 2, wherein said front wall is formed integrally with said front shell (8) .

9. Clothes washing machine according to claim 3, wherein said front wall is formed integrally with said annularly shaped front shell (8).

10. Clothes washing machine according to claim 2, wherein said counterweights (6,7) comprise calcium carbonate.

11. Clothes washing machine according to claim 1, wherein said tub rear wall (4) defines an outer circular edge and at least one of said plastic shells (9) is attached on said tub at said rear wall (4) thereof, the projecting element (11) of said shell (9) at said rear wall being arranged to fittingly match against the corresponding projecting element (13), and the corresponding projecting element being provided substantially on the outer circular edge of said tub rear wall (4).

12. Clothes washing machine according to claim 11, wherein said counterweights (6,7) comprise calcium carbonate.

13. Clothes washing machine according to claim 1, wherein said counterweights (6,7) comprise calcium carbonate.

* * * * *

UNITED STATES PATENT AND TRADEMARK OFFICE

CERTIFICATE OF CORRECTION

PATENT NO. : 5,419,164

DATED : May 30, 1995

INVENTOR(S) : Pierro Durazzani

It is certified that error appears in the above-indentified patent and that said Letters Patent is hereby corrected as shown below:

Title page, item [30] Foreign Application Priority Data, delete "PN92A0091" and insert —PN92A000091—.

Column 4, line 20, (claim 1, line 4) after "(14)" insert --,-- (comma);

Column 4, line 65, (claim 8, line 3) delete "front shell (8)" and insert --shell (8) at said front opening--; and
line 68, (claim 9, line 3) delete "front shell (8)" and insert --shell (8) at said front opening--.

Signed and Sealed this

Twenty-eighth Day of November 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,419,164

DATED : May 30, 1995

INVENTOR(S) : Piero Durazzani

It is certified that error appears in the above-indentified patent and that said Letters Patent is hereby corrected as shown below:

On the title page: Item [73] Assignee: should read -- Zanussi Elettrodomestioi S.P.A., Pordenone, Italy --.

Item [56] Attorney, Agent or Firm: should read -- Pearne, Gordon, McCoy & Granger --.

Signed and Sealed this

Thirteenth Day of February, 1996

*Attest:*

Bruce Lehman

BRUCE LEHMAN

*Attesting Officer*

*Commissioner of Patents and Trademarks*